United States Patent [19]

Tooth

[11] 4,183,989

[45] Jan. 15, 1980

[54] SECURITY PAPERS

[75] Inventor: Alan J. Tooth, Whitchurch, England

[73] Assignee: Portals Limited, Hampshire, England

[21] Appl. No.: 855,671

[22] Filed: Nov. 29, 1977

[30] Foreign Application Priority Data

Dec. 7, 1976 [GB] United Kingdom ..... 51047/76

[51] Int. Cl.[2] ..... B41M 3/14; B44F 1/12

[52] U.S. Cl. ..... 428/195; 427/7; 428/208; 428/209; 428/900; 428/916

[58] Field of Search ..... 428/195, 208, 209, 900, 428/916; 427/7

[56] References Cited

U.S. PATENT DOCUMENTS

| | | | |
|---|---|---|---|
| 3,679,449 | 7/1972 | Nagot et al. | 427/7 |
| 3,713,861 | 1/1973 | Sharp | 427/7 |
| 3,886,083 | 5/1975 | Laxer | 428/195 |
| 3,919,447 | 11/1975 | Kelmer et al. | 428/916 X |
| 3,928,226 | 12/1975 | McDonough et al. | 428/916 X |
| 4,066,280 | 1/1978 | LaCapria | 427/7 X |
| 4,069,367 | 1/1978 | Ameki et al. | 428/900 X |

*Primary Examiner*—Thomas J. Herbert, Jr.
*Attorney, Agent, or Firm*—Buell, Blenko & Ziesenheim

[57] ABSTRACT

A security paper which contains a security device e.g. a strip, thread or planchette having at least two machine verifiable security features thereon, one of which is a magnetic material, which may be magnetically coded or printed in a predetermined pattern on the device, and a second of which is a luminescent material, an X-ray absorbent or a metal. The provision of several features on one device provides a large increase in document security.

13 Claims, No Drawings

SECURITY PAPERS

FIELD OF THE INVENTION

The invention relates to security papers; for example, papers for banknotes and cheques, to their manufacture, and to methods for their verification.

Security papers are used in the manufacture or construction of banknotes, cheques, tickets, credit or other cards or documents used for purposes which make the verification by machinery of the authenticity of each specimen desirable at least once in its lifetime.

SUMMARY OF PRIOR ART

It is known that security papers may be rendered distinguishable from counterfeits and one from another by including magnetic materials in various forms within the body of the paper. These inclusions may be introduced during manufacture of the paper and may be made from a variety of magnetic materials in various forms and shapes. For example, the inclusion may take the form of a continuous thread or ribbon, of regenerated cellulose, polyvinyl chloride or other plastics film coated with a layer of magnetic material. Alternatively, the inclusion may be in the form of planchettes of plastics or paper or assemblies thereof which have been coated with magnetic materials before inclusion into the paper such as disclosed in British patent specification No. 1,127,043.

Furthermore, it is known that the magnetic materials of the above described security papers having the above features may be detected by suitable devices arranged to measure characteristic properties of the particular magnetic materials provided or to detect the particular magnitude or configuration of the magnetic fields associated with those features. For example, the magnetic coating may be applied discontinuously on to a thread or ribbon so that, when magnetised, and subjected to relative movement with a field detecting device or devices the original discontinuities can be detected and their authenticity identified. Alternatively, the magnetic materials may be permanently "coded" by treatment during the magnetic coating process as described in line 68, page 3 of British patent specification No. 1,127,043 and later disclosed in detail in British patent specification No. 1,331,604 such that later remagnetisation produces a field which varies in accordance with the original coding pattern, which field may be detected and verified when a document containing the original feature is read by a suitable field detecting device.

It is known from British patent specification No. 1,127,043 that a coding pattern may be produced by providing two different magnetic materials alternating in bands along a security strip of plastics material.

More broadly, it is generally accepted by those skilled in the art that the use of a plurality of security features in a given document provides a disproportionate increase in protection from imitation over the level of protection afforded by a single security feature. Thus, it has been proposed that documents which contain one particular form of the magnetic security devices described above should additionally be provided with a second, separate machine readable feature.

Many such additional features are known and may be applied by printing or coating special designs or materials on to the surface of the paper. For example part of the printed design may be applied by the intaglio printing process and genuine documents may then be identified by detecting the raised or embossed nature of that portion of the print; or a visible pattern may be printed in whole or in part in a metameric ink such that a colour change can be detected in a suitable photo-electric detector when the paper is illuminated first with one source of light and then another.

These known inclusions can provide a wide range of degrees of security and utility depending on their precise nature. The greater their complexity or the degree of technical difficulty in their manufacture or the greater the rarity of the materials the greater is the level of the security provided. It is unfortunately also true that their security and utility are often inversely related. That is, when substantial security is provided by way of substantial complexity, then the utility may be reduced because documents made from paper containing these complex inclusions may only be reliably verified at low speed, or when in pristine condition, or by complex and expensive equipment of a kind which can only be set up in some central permanent establishment.

It has been found that there is a need to verify many security documents, notably banknotes, in a number of different situations. For example, the authenticity of a banknote may require verification when the note is one of many thousands which are examined immediately prior to destruction. In this case, a high level of security is required and, in general, this necessitates the use of an inclusion characterized by the fact that the magnetic properties are complex. Technically advanced and costly equipment is required for their detection. This is consistent with the location wherein such operations usually occur; for example, in large permanent establishments administered by or run on behalf of a Central Bank. It is, however, an unfortunate fact that these same banknotes may also require verification in different circumstances characterized in that verification of a relatively small number of notes at any time may be required and the equipment for verification may be in field locations and must either be portable or low in capital cost. Such circumstances apply when verification is to be carried out by a member of the public, or by a cashier at a small branch bank, or when the banknote is to be verified within a note accepting machine which dispenses goods or services.

Further problems that arise in respect of known security papers having two separately applied features are that the provision of two security devices is relatively expensive, each feature requires an area of the banknote, and each security feature can be separately examined and imitated by a would-be imitator.

GENERAL DESCRIPTION OF THE INVENTION

The present invention provides a security paper which contains a security device having at least two distinct machine verifiable security features being a magnetic material and a second being one of:

(a) a luminescent material,
(b) an X-ray absorbent, or
(c) a metal.

The present invention includes a process for making a security paper which process comprises incorporating with the paper a security device which has at least two distinct machine verifiable security features, a first of the security features being a magnetic material and a second being one of:

(a) a luminescent material,
(b) an X-ray absorbent, or (c) a metal.

The present invention further provides a method of verifying a security paper which paper contains a security device having at least two distinct security features which method comprises detecting by a machine a magnetic property of a magnetic material which is a first of the said security features and also detecting by a machine a second of the said security features by one of the following:

(a) the luminescence of the security device, (b) the absorption of X-rays by the security device, or (c) the presence of metal in the security device.

It is to be understood that the magnetic property and the second security feature may be detected sequentially in either order or simultaneously, and the security device may have other security features which are also detected e.g. by method (a), (b) or (c) above simultaneously or sequentially in any order.

Also within the scope of the invention is a document verifying machine comprising means for machine verifying a security device present in a security paper said security device having at least two distinct features, a first of the security features being a magnetic material and a second being one of:

(a) a luminescent material, (b) an X-ray absorbent, or (c) a metal, said means being able to separately verify both of the said security features either together or separately and means operative in response to verification of a genuine document to perform a desired function. Such a machine may be a vending machine or a document sorting machine, e.g. a sorting machine wherein a stack of notes may be manually or mechanically transported to the machine which then mechanically removes individual notes in rapid succession from the stack and transports them past appropriate condition sensing, counting and authenticity testing devices and thereafter separating the notes into different stacks i.e., fit for circulation, unfit for circulation and of questionable authenticity.

Devices may be used for verifying papers of the invention which may be moved manually with respect to the security device and which give rise to appropriate responses within the device or within themselves and includes note accepting machines of all kinds wherein the note may be manually placed on to a tray or into a slot whereafter the note is drawn into the machine mechanically for verification.

Preferably a security paper of the invention contains a security device which comprises a substrate having a magnetic powder layer thereon.

It will be understood by those skilled in the art that the quantity of all such magnetic and other materials provided within the security device will be sufficient to render the magnetic and other properties of each material detectable in a security document made from the security paper.

The invention includes security documents such as banknotes, cheques or security cards whenever made from the security papers of the invention.

DETAILED DESCRIPTION OF THE INVENTION

Security devices usable in the present invention include threads, planchettes and fibres.

The threads, planchettes, fibres or the like may be manufactured from a non-magnetic material containing or supporting other materials at least one of which shall have detectable magnetic characteristics; alternatively the threads, planchettes or fibres may be manufactured from a magnetic material with detectable magnetic properties containing or supporting other materials which may be non-magnetic or magnetic. In all cases, the materials providing the second machine verifiable security feature shall have some property the presence of which in security documents made from security paper in accordance with the invention can be verified with suitable detectors and is independent of the magnetic property of the magnetic material.

In the case of security devices made from magnetic materials comprising metals, ceramics or plastics materials with magnetic material filler, a foil of the magnetic material may be produced, coated with the other magnetic and/or non-magnetic materials and then subdivided into threads or planchettes. Fibres may be produced from the said magnetic materials by any known convenient method of producing fibre-like particles of solid material such as shaving, skiving, turning, extrusion, blowing, cutting, growing whiskers or deposition the fibres thus produced then being coated with other magnetic and/or non-magnetic materials by any known convenient method such as dipping, spraying or deposition.

In the case of security devices made from non-magnetic materials supporting magnetic and supporting or containing other non-magnetic coatings, for example regenerated cellulose, such as Cellophane (Registered Trade Mark), glass, alginate, plastics, natural or synthetic papers or other thin materials, sheets or webs of these materials may be coated with magnetic material and then with another magnetic or non-magnetic material by dipping, vacuum deposition, electrodeposition or other known process, with or without adhesives and thereafter sub-divided into threads, planchettes or fibres.

The security devices provided by the invention include those which are non-uniform in shape. For example, planchettes in accordance with the invention may be non-planar and/or may be regular or irregular in shape.

In all of these methods of manufacture the magnetic coatings may comprise any convenient medium having the required covering and adhesive properties loaded with magnetic material.

Luminescent materials e.g. fluorescent in the security devices of the invention may be detected by irradiation with a source appropriate for the material, e.g. an ultraviolet light source or a source of energetic particles.

Usually but not necessarily, the emitted wavelength will be longer than that of the stimulating radiation. Machine reading of these forms of this embodiment of the invention will involve the first step of applying the appropriate stimulation or irradiation and the second step of detecting the emission which will constitute electromagnetic waves having wavelengths within the band 0.1 to 1000 $\mu$m. Appropriate detectors as will readily occur to those skilled in the art will include photoelectric detectors and spectrophotometers responsive to emissions in the infra-red, visible and ultraviolet sections of the above band.

A large number of materials which exhibit appropriate properties for the above embodiment of the invention will be known to those skilled in the art. They include aniline dyes such as eosin and fluorescein; materials such as fluorspar, sulphate of quinine, fuchsin and calcium sulphide. Certain rare earth compounds such as Neodymium salicylate, Samarium gluconate and Yttrium salicylate may also be employed.

The security devices according to the present invention may be incorporated into security papers during manufacture by the techniques commonly employed in the security paper-making industry. For example, a thread may be unwound from a bobbin into a cylinder mould papermaking machine, or similar machine of known type, so that it is incorporated into a central layer of the paper in the course of manufacture preferably but not necessarily within a section of the paper containing a watermark of characteristic form. Alternatively, fibre-like pieces or fibres or planchettes made in accordance with the invention may be mixed with the stock suspension fed to the papermaking machine so that the special fibres or planchettes are randomly distributed amongst the normal papermaking fibres forming the security paper. Or, preferably, the special fibres or planchettes may be introduced in a dilute suspension in water to a cylinder mould machine, or similar papermaking machine of known type, along with an appropriate suspension of papermaking fibres in such a way that the special fibres or planchettes only appear in designated bands within the security paper.

The detection of the magnetic properties of the security devices introduced into security papers in accordance with the method of the recent invention may be carried out for example by detectors which depend upon intrinsic magnetic properties such as permeability, retentivity, hysterisis loss and coercivity or upon special magnetic properties given to the magnetic material in the course of, or subsequent to, the production of the security device such as discontinuities in the magnetic material or coded variations in the magnetisation of the material or variations in the magnetisation of the material which are evident even after uniform re-magnetisation. Preferably, where coded variations in magnetisation are applied after manufacture of the security device, the magnetic material will have a high coercivity and remanence such that the coded variations may not be easily obliterated by mischievous or accidental demagnetisation subsequent to the original magnetisation. For example, the coercivity and remanence will, preferably, be greater than 1000 oersteds and 65% of the magnetisation at saturation respectively.

The detection of X-ray absorbent materials may be performed by detecting the level of transmittance of X-rays from a source of known power (e.g. 10 to 7000 watts) through the paper by the use of an X-ray detector (e.g. a scintillation counter), and comparing this with the transmittance of standard plain paper, e.g. paper adjacent the security device.

Of course the magnetic material incorporated in the device will have some X-ray absorbence. "X-ray absorbence materials" as the term is used herein includes salts and oxides of transition and heavy metals such as barium, lanthanum, caesium etc.

The magnetic material and the other security feature required in the practice of the present invention may be detected and verified individually or together. The verification of the features together may be performed with separate detectors whose outputs are combined to form an aggregate output which is used for verification. Alternatively, a single detector may be employed which responds to both features. For instance, a security device in the form of a strip, metallized on one side and bearing a magnetic material on the other may be detected and verified using a single eddy current detector in which the strip will cause an effect not obtainable by the use of either security feature alone.

Examples of different embodiments of the invention will now be described. It is to be noted that the invention is not limited to the particular embodiments described.

EXAMPLE 1

A sheet of polyester film is vacuum metallized on one side with aluminium and, on the other side a coating comprising magnetic powder, solvents, resins and waxes is applied from a gravure coating roll and dried. The sheet is then slit to form security threads or strips and is inserted into a web of security paper during manufacture thereof. The sheet is then printed and cut into smaller sheets of banknote size.

In use, whenever the authenticity of banknotes prepared in accordance with the above embodiment of the invention is to be verified, the presence of the metal may be detected by appropriate known means such as its effect on a balanced capacitative or inductive circuit or the presence of the magnetic material may be detected by known means such as first magnetising the material and then detecting the resultant magnetic field by suitable known means such as a flux-sensitive detector; alternatively, when authenticity is to be established with a greater degree of certainty and when the conditions and circumstances of verification permit, both the presence of the metal and magnetic materials may be detected by known means such as those indicated above.

EXAMPLE 2

A polyester film is provided with aluminium and magnetic coatings as described generally in Example 1 but in this particular embodiment, the uniformity and thickness of the aluminium coating is carefully controlled so that the superficial conductivity of the coating has a particular value at all locations. Similarly, the magnetic powder, its preparation and coating are controlled such that one of the magnetic characteristics of the security device falls within close, predetermined limits all over the surface of the security device. For example, the coercivity may be controlled to within $\pm 10\%$ of some predetermined value. The sheet material prepared as above is slit into threads $\frac{3}{4}$ mm wide, incorporated into security paper which is printed and cut into banknotes.

In use, the authenticity of the banknotes prepared in accordance with the above embodiment of the invention may be verified by determining that either the conductivity lies within the predetermined limits or that the coercivity of the magnetic material lies within the predetermined limits or both. Known methods of carrying out these determinations include, for coercivity magnetic saturation followed by reversed magnetisation in a known field followed by detection of the remaining magnetisation from which the coercivity of the magnetic material may be deduced; for conductivity a non-contacting determination using any one of several known methods which may include capacitative or inductive or other appropriate means.

EXAMPLE 3

A sheet of polyester film is first coated with a layer of magnetic material and is adhesive laminated to a second sheet of polyester film by known means so that the magnetic material lies between the two sheets of film.

The composite sheet thus produced is then coated on both sides by known means with a lacquer loaded with a powdered material of a kind which is opaque and which fluoresces under UV light. The resulting sheet is then divided into a large number of planchettes by a suitable punch and die such that each planchette has a diameter of approximately 1.0 mms. The planchettes are then introduced into security paper during its manufacture so that in the finished paper the planchettes are randomly distributed in the sheet and on average, three planchettes lie within each square centimeter of the paper.

In verifying the authenticity of banknotes cut from security paper made in accordance with the above embodiment of the invention, the presence of the fluorescent material is detected by irradiating the paper with ultraviolet light and then detecting the visible light emitted by the fluorescent planchettes by a suitable photo-electric cell and an appropriate amplifier and indicator circuit. On other occasions in different locations, the presence of the magnetic layer (which is not visible to the eye even on close inspection of the planchettes) is detected by any known means appropriate to the type of magnetic material or its predetermined state of magnetisation.

EXAMPLE 4

A continuous web of aluminium foil is laminated to a web of regenerated cellulose film which has previously been uniformly coated with a layer of magnetic material.

The resulting web is slit into continuous ribbons 1.2 mms wide which are incorporated into the body of a security paper during its manufacture so that the ribbons appear as a security thread in each document subsequently made from the paper.

To detect the presence of the security thread a search coil, supplied with alternating current in the range 100 to 500 kHz is moved past the document in close proximity to the thread therein. By suitable means known to those skilled in the art, changes in the amplitude and phase of the coil current, which occur as the thread passes the coil, are detected.

By judicious selection of the thickness of the aluminium foil, the weight and physical properties of the magnetic coating and the frequency of the voltage applied to the coil the above changes in coil current can be adjusted to values which cannot easily be obtained from any material other than the secret combination provided by the invention.

EXAMPLE 5

Prior to extrusion to form a loaded polyester film 0.030 mms thick, fine particles of appropriate salts, e.g. of barium, are mixed with the polyester material.

The resulting loaded polyester film is then coated with magnetic material in the manner described in Example 1, above.

The composite material is then slit into long, narrow strips and run into paper to form security threads such that a security thread appears in each genuine banknote subsequently printed and out from the paper.

To verify that any particular specimen of banknote presented to a note accepting and goods dispensing machine is, in fact, likely to be genuine the specimen is moved past a magnetic detector of the type described in Example 4 hereinabove. If the predetermined level of remanent magnetisation is found then the banknote is accepted and the appropriate goods are dispensed.

To verify beyond any reasonable doubt that a badly worn and soiled specimen of banknote which is about to be withdrawn from circulation and then destroyed is, in fact, genuine it is first tested as described above.

It is then tested for a second time by moving it between a source of X-rays and an X-ray detector which provides an output voltage whose value is proportional to the quantity of radiation received. Because of the unusually high absorption of X-ray radiation exhibited by the salt-loaded film, the voltage output from the detector will exhibit a substantial fall as the document moves past if the document contains a genuine security thread of the kind described above.

If both tests are satisfied by a particular banknote then the note may, beyond reasonable doubt, be regarded as genuine and may be withdrawn from circulation and destroyed without further investigation.

EXAMPLE 6

A barium-loaded polyester film as described in Example 5 was extruded to a thickness of 0.020 mms.

It was then adhesively laminated to a polyester film of 0.020 mms thickness which had been previously vacuum metallized with aluminium on one side and coated with a lacquer containing magnetic material on the other side.

The resulting laminate was then coated on both sides with a lacquer containing a phosphor.

The above composite material was slit into continuous ribbons 0.65 mms wide and incorporated into security paper as security threads. The paper was then printed and divided into numbered banknotes such that each note, being 150 mms × 75 mms contained a security thread as above described running across the 75 mm dimension.

When the above banknotes were put into circulation it was found that the authenticity of individual specimens could be satisfactorily tested with devices and machines appropriate to the needs and location. For example, Bank Cashiers were provided with a magnet and field sensitive viewer of known kind and merely by sliding first the magnet and then the viewer over the note were able to confirm the presence of the magnetic material in the security threads of genuine notes; Post Office clerks were provided with a portable lamp radiating UV waves and were able to verify that notes containing genuine phosphor-coated threads omitted a characteristic colour when held under the lamp and exhibited an after-glow when removed therefrom; in Railway ticket offices and in garages, ticket issuing and petrol dispensing machines of known type were installed wherein individual specimens of the above banknote were first placed by the would-be purchaser into a tray and then carried by a transport mechanism into the body of the machine wherein first the presence of the metallic layer was detected by a device sensitive to the electrical capacitance of the layer then the presence of the magnetic layer was confirmed by magnetisation followed by field detection whereupon, in those cases where both tests resulted in prescribed signal levels, the machines automatically issued the required ticket or switched-on the petrol dispensing equipment; in other cases vending machines of known kinds were fitted with magnetic and phosphor detecting devices which latter devices included colour filters and timing controls to ensure that only banknotes containing threads embodying the prescribed phosphorescent colour and after-glow properties were accepted; finally, in regional offices of the Banknote Issuing Authority wherein large numbers of banknotes were removed from circulation and collected into stacks the stacks then being manually placed in the receptacle of a sorting machine of known kind wherein individual notes were mechanically removed from the stack in rapid succession and conveyed by a transport system comprising vacuum devices, belts and belt guides of known kind past detecting and sensing devices sequentially arranged along the path followed by the notes through the machine and providing appropriate signals to note deflectors such that individual notes could be separated and counted into different stacks depending on their physical condition (clean or soiled; damaged or undamaged) it was found possible by providing additional detectors and an additional deflector to test each sample note for the presence of the metallic, magnetic, phosphorescent and X-ray absorbent properties of the threads prescribed for genuine notes and to separate into an additional reject stack any note which failed to satisfy any one of these sequential tests for authenticity whereafter the notes so rejected were removed and sent for laboratory examination.

It was found that, because of the versatility and the relatively low cost of the security thread provided by this embodiment of the invention and because of the ease of applying appropriate authenticity tests as also provided by the invention throughout the useful life of the notes in circulation, that the overall security against counterfeiting of this particular banknote could be maintained at a very high level very economically indeed.

EXAMPLES 7–12

It will be appreciated that numerous different embodiments may be conceived in accordance with the invention. The appended table contains summarized descriptions of several of these.

| Appropriate Form | Construction | Detection procedures | Important/Special Characteristics |
|---|---|---|---|
| 7. Threads | Cellulose film coated with magnetic material having a specified coercivity and laminated to a foil of non-magnetic metal e.g., aluminum. | a. Magnetise to saturation, reverse magnetise in lower field detect remaining magnetisation as measured in reading coil.<br>b. Microwave radiator operating at 10,000 MHz (X Band) is used to irradiate the paper in the area of the security device. The radiator is designed to produce a radiant field having the aspect ratio corresponding to that of the security device such that waves occurs at the security device and can be detected. | This embodiment affords a high level of security when detected as described. In particular, only the combination of a magnetic coating of the prescribed coercivity and remanence with a metal foil having a predetermined aspect ratio (ratio of major X - axis to major Y - axis) will satisfy the detector. |
| 8. Threads and planchettes | As Example 7. | a. Magnetise and detect resulting field in simple reading head.<br>b. Detect presence of foil using capacitative probe and noting change in magnitude of high frequency current in circuit supplying probe. | Although the product is identical with that in Example 7, the versatility is such that much simpler and less costly detection processes, giving adequate certainty of detection for many purpose, can be used. |
| 9. Threads and planchettes | Polyester film coated with a composition which includes magnetic particles and particles of a material which fluoresces under UV irradiation. | a. Detect presence of magnetic particles by passing document through a magnetic field and detecting flux in vicinity of security device.<br>b. Detect presence of fluorescent particles by irradiating with UV and detecting visible light output in photo-electric detector sensitive to the particular colour frequency emitted by the fluorescent material provided in genuine documents. | Variations in the ratio of the quantities of magnetic and fluorescent particles provides a means of matching the properties of the security device to particular detecting equipments from the known range; thus providing economy and security. |
| 10. Threads | Polyester film is printed on one side with a composition which includes magnetic material such that the material is deposited in a regular pattern along the length of threads slit from the film. Similarly, the above printed film is then printed with an additional regular pattern formed in a coating composition which includes a UV fluorescent material.<br>Preferably, the patterns formed in the magnetic and fluorescent materials are identical and are | a. The variations in magnetic flux are detected in a known detector moved along the length of thread which has been subjected to a uniform field.<br>b. Similarly, the variations in visual light output along the length of the thread which has been uniformly irradiated with UV are detected in a known photo-electric device.<br>c. Preferably, the above two output signals are applied to a phase sensitive detection circuit of known type and the phase relationship is shown to be substantially constant for | Significant level of security from imitation, particularly in the preferred embodiment. |

-continued

| Appropriate Form | Construction | Detection procedures | Important/Special Characteristics |
|---|---|---|---|
| | registered one to the other. | genuine documents. | |
| 11. Threads | A ribbon of nickel alloy is drawn down to a thickness of about 0.02 mms and is then coated on both sides with magnetic material. Before or after insertion into security paper the magnetic layer is sequentially magnetised along its length with opposing fields such that the layer exhibits magnetic flux reversal at each increment of 2 mms along the length. | The presence of the magnetic and metal alloy materials are separately detected by any of the above or other known means as appropriate. | The significant differences in the elastic properties of the nickel alloy ribbon compared with threads of plastics film used hitherto can be particularly advantageous under certain manufacturing circumstances.<br><br>In particular, for example, the high tensile strength of the alloy reduces thread breakages during manufacture of the paper but, at the same time, provides a metallic layer for detection purposes. |
| 12. Threads | A vacuum-metallized polyster film is coated on one side with a layer of magnetic material having a coercivity in excess of 1000 oersteds and a remanence greater than 70% of the flux density at saturation. Before or after insertion into the paper, threads slit from the film are magnetised so that the magnetisation varies in a regular pattern along the length of the threads.<br><br>The metallized, magnetically coated film is then coated on both sides with a composition containing white pigment. | a. The vacuum-metallized layer is detected by any appropriate method as described above or known in the art which is not affected by the magnetic field variations. For example, by capacitative means.<br><br>b. The variations in magnetic field emanating from the magnetised magnetic layer are detected by other known means; for example, by applying relative movement between a read head and the thread in a direction along the length of the thread. | The strong, varying magnetic field may, in spite of the white pigment, be noticed by the would-be counterfeiter.<br><br>The metallic later is likely to remain unnoticed by the counterfeiter. |

It is to be understood that the invention also includes the security devices described above, which devices may be sold to papermakers for inclusion into security papers.

A principal advantage of security papers according to this invention is that an imitator cannot determine the number of security features simply by counting the number of areas in which security devices appear. The superimposing of two or more security features provided by this invention can make it very difficult to ascertain how many features are present. Economic advantages also acrue from the use of one rather than two security devices in the manner exemplified above.

I claim:

1. A security paper which contains a security device lying substantially within the body of the paper and having at least two distinct machine verifiable security features, a first of the security features being a magnetic material and the second feature being a second and different material selected from the group consisting of:

a. a luminescent material, b. an x-ray absorbent, and c. a non-magnetic metal.

2. A security paper as claimed in claim 1, wherein the security device contains a luminescent material selected from the group consisting of eosin, fluorescein, fluorspar, sulphate of quinine, fuchsin, calcium sulphide, Neodymium salicylate, Samarium gluconate or Yttrium salicylate.

3. A security paper as claimed in claim 1 wherein the magnetic material has variations in its magnetisation coded thereon.

4. A security paper as claimed in claim 1, wherein the security device comprises a plastics substrate having a magnetic powder layer thereon.

5. A security paper as claimed in claim 44, wherein the non-metallic substrate has a layer of metal thereon, formed by a technique selected from the group consisting of vacuum deposition, laminating a metal foil to the plastics substrate film, and adhering a layer of metal powder to the plastics substrate film.

6. A security paper as claimed in claim 1, wherein the security device is a strip having at least one security feature printed in a predetermined pattern along the length thereof.

7. A security paper as claimed in claim 6 having the magnetic material and a luminescent material printed in register thereon.

8. A security paper which contains a security device which is a strip of plastics film bearing as a first independently machine verifiable security feature a coating of a non-magnetic metal and as a second independently machine verifiable security feature a coating of a particulate magnetic material.

9. A process for making a security paper, which process comprises incorporating within the paper a security device which has at least two distinct machine verifiable security features, a first of the security features being a magnetic material and a second feature being selected from the group consisting of:

(a) a luminescent material, (b) an X-ray absorbent, and (c) a non-magnetic metal.

10. A method of verifying a security paper which paper contains a security device having at least two distinct security features which method comprises detecting by a machine a magnetic property of a magnetic material which is a first of the said security features and also detecting by a machine a second of the said security features by a property selected from the group consisting of:

(a) the luminescence of the security device, (b) the absorption of X-rays by the security device, and (c) the presence of non-magnetic metal in the security device.

11. A method as claimed in claim 10, wherein the presence of metal is detected by a property selected from the group consisting of the reflectivity of the metal to electromagnetic radiation and the effect of the metal on a balanced circuit selected from the group of balanced capacitative and inductive circuits.

12. A method as claimed in claim 10, wherein the magnetic property of the magnetic material is a property which varies in a predetermined manner along the length of an elongate security device.

13. A method as claimed in claim 12, wherein the variation of the magnetic property is detected and compared with a variation along the length of the security device of property selected from the group consisting of:

(a) the luminescence of the security device, (b) the absorption of X-rays by the security device, and (c) the presence of metal in the security device.

* * * * *

UNITED STATES PATENT AND TRADEMARK OFFICE

CERTIFICATE OF CORRECTION

PATENT NO. : B1 4,183,989

DATED : May 8, 1990

INVENTOR(S) : Alan J. Tooth

It is certified that error appears in the above-identified patent and that said Letters Patent is hereby corrected as shown below:

Claim 8, line 44, column 2, "particular" should read --particulate--.

Signed and Sealed this

Seventh Day of April, 1992

*Attest:*

*Attesting Officer*

HARRY F. MANBECK, JR.

*Commissioner of Patents and Trademarks*

REEXAMINATION CERTIFICATE (1267th)

United States Patent [19]

Tooth

[11] B1 4,183,989

[45] Certificate Issued May 8, 1990

[54] SECURITY PAPERS

[75] Inventor: Alan J. Tooth, Whitchurch, England

[73] Assignee: Portals Limited, Hampshire, England

Reexamination Request:
No. 90/001,769, May 4, 1989

Reexamination Certificate for:

| | |
|---|---|
| Patent No.: | **4,183,989** |
| Issued: | **Jan. 15, 1980** |
| Appl. No.: | **855,671** |
| Filed: | **Nov. 29, 1977** |

[30] Foreign Application Priority Data

Dec. 7, 1976 [GB] United Kingdom ..... 51047

[51] Int. Cl.[5] ..... B41M 3/14; B44F 1/12

[52] U.S. Cl. ..... 428/195; 427/7; 428/208; 428/209; 428/900; 428/916

[58] Field of Search ..... 162/103; 428/195, 208, 428/209, 900, 916; 427/7

[56] References Cited

U.S. PATENT DOCUMENTS

| | | | |
|---|---|---|---|
| 3,679,449 | 7/1972 | Nagot et al. | 427/7 |
| 3,713,861 | 1/1973 | Sharp | 427/7 |
| 3,880,706 | 4/1975 | Williams | 162/103 |
| 3,886,083 | 5/1975 | Laser | 428/195 |
| 3,919,447 | 11/1975 | Kelmer et al. | 428/916 X |
| 3,928,226 | 12/1975 | McDonough et al. | 428/916 X |
| 4,066,280 | 1/1978 | LaCapria | 427/7 X |
| 4,069,367 | 1/1978 | Ameki et al. | 428/900 X |

FOREIGN PATENT DOCUMENTS

| | | |
|---|---|---|
| 472081 | 6/1969 | Switzerland . |
| 1095286 | 12/1967 | United Kingdom . |
| 1127043 | 9/1968 | United Kingdom . |
| 1305931 | 2/1973 | United Kingdom . |
| 1411477 | 10/1975 | United Kingdom . |

*Primary Examiner*—T. J. Herbert, Jr.
*Attorney, Agent, or Firm*—Frederick B. Ziesenheim

[57] ABSTRACT

A security paper which contains a security device e.g. a strip, thread or planchette having at least two machine verifiable security features thereon, one of which is a magnetic material, which may be magnetically coded or printed in a predetermined pattern on the device, and a second of which is a luminescent material, an X-ray absorbent or a metal. The provision of several features on one device provides a large increase in document security.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Delete Example 11 bridging Columns 11 and 12, as follows:

-continued

| Appropriate Form | Construction | Detection procedures | Important/Special Characteristics |
|---|---|---|---|
| | registered one to the other. | genuine documents. | |
| [11. Threads] | [A ribbon of nickel alloy is drawn down to a thickness of about 0.02 mms and is then coated on both sides with magnetic material. Before or after insertion into security paper the magnetic layer is sequentially magnetised along its length with opposing fields such that the layer exhibits magnetic flux reversal at each increment of 2 mms along the length.] | [The presence of the magnetic and metal alloy materials are separately detected by any of the above or other known means as appropriate.] | [The significant differences in the elastic properties of the nickel alloy ribbon compared with threads of plastics film used hitherto can be particularly advantageous under certain manufacturing circumstances.<br><br>In particular, for example, the high tensile strength of the alloy reduces thread breakages during manufacture of the paper but, at the same time, provides a metallic layer for detection purposes.] |

AS A RESULT OF REEXAMINATION, IT HAS BEEN DETERMINED THAT:

Claims 1, 9–12 and 13 are cancelled.

Claims 2–6 and 8 are determined to be patentable as amended.

Claim 7, dependent on an amended claim, is determined to be patentable.

New claims 14 and 15 are added and determined to be patentable.

2. A security paper as claimed in claim [1,] *14*, wherein the security device contains a luminescent material selected from the group consisting of eosin, fluorescein, fluorspar, sulphate of quinine, fuchsin, calcium sulphide, Neodymium salicylate, Samarium gluconate or Yttrium salicylate.

3. A security paper as claimed in claim [1] *14* wherein the magnetic material has variations in its magnetisation coded thereon.

4. A security paper as claimed in claim [1], *14* wherein the security device comprises a plastics substrate having a magnetic powder layer thereon.

5. A security paper as claimed in claim [44], *4* wherein the [non-metallic] substrate has a layer of metal thereon, formed by a technique selected from the group consisting of vacuum deposition, laminating a metal foil to the plastics substrate film, and adhering a layer of metal powder to the plastics substrate film.

6. A security paper as claimed in claim [1], *14* wherein the security device is a strip having at least one security feature printed in a predetermined pattern along the length thereof.

8. A security paper *as claimed in claim 14* which contains a security device which is a strip of plastics film bearing as a first independently machine verifiable security feature a coating of a non-magnetic metal and as a second independently machine verifiable security feature a coating of a particular magnetic material.

*14. A security paper which contains a security device which comprises at least two distinct security features, one of said security features being a magnetic material which is carried by a flexible substrate, and the second security feature being a material selected from the group consisting of (a) a luminescent material and (b) a non-magnetic metal, wherein the individual security features are independently machine verifiable, and the security features are superimposed so that there is difficulty in visually determining whether more than one security feature is present in the security device.*

*15. A paper as claimed in claim 14 wherein the security device comprises a layer of magnetic material supported by the flexible substrate with at least one second security feature superimposed both above and below the magnetic material.*

* * * * *